US007812703B2

(12) United States Patent
Carlson et al.

(10) Patent No.: US 7,812,703 B2
(45) Date of Patent: Oct. 12, 2010

(54) MEMS DEVICE USING NIMN ALLOY AND METHOD OF MANUFACTURE

(75) Inventors: Gregory A. Carlson, Santa Barbara, CA (US); John S. Foster, Santa Barbara, CA (US); Donald C. Liu, Santa Maria, CA (US); Douglas L. Thompson, Santa Barbara, CA (US)

(73) Assignee: Innovative Micro Technology, Goleta, CA (US)

( * ) Notice: Subject to any disclaimer, the term of this patent is extended or adjusted under 35 U.S.C. 154(b) by 1238 days.

(21) Appl. No.: 11/386,733

(22) Filed: Mar. 23, 2006

(65) Prior Publication Data

US 2007/0222004 A1 Sep. 27, 2007

(51) Int. Cl.
*H18H 71/18* (2006.01)

(52) U.S. Cl. ..... 337/139; 337/123; 200/266

(58) Field of Classification Search ..... None
See application file for complete search history.

(56) References Cited

U.S. PATENT DOCUMENTS

| | | | | |
|---|---|---|---|---|
| 5,764,056 | A | 6/1998 | Mao et al. | |
| 6,859,304 | B2 | 2/2005 | Miller et al. | |
| 6,869,690 | B1 | 3/2005 | Hodgens et al. | |
| 6,902,827 | B2 | 6/2005 | Kelly et al. | |
| 2002/0105396 | A1* | 8/2002 | Streeter et al. | 335/78 |
| 2003/0222337 | A1* | 12/2003 | Stewart | 257/684 |
| 2003/0228096 | A1 | 12/2003 | Parker et al. | |
| 2004/0031691 | A1* | 2/2004 | Kelly et al. | 205/104 |
| 2007/0018077 | A1 | 1/2007 | Puscasu et al. | |
| 2008/0124565 | A1 | 5/2008 | Carlson et al. | |

OTHER PUBLICATIONS

Goods, S.H., Electrodeposited nickel-manganese: an alloy for microsystem applications, Dec. 2004, Springer-Verlag, vol. 10, pp. 498-505.*

"The electrical resistivity of nickel and its alloys," T. Farrell et al., J. Phys. C (Proc. Phys. Soc.), 1968, ser. 2, vol. 1, pp. 1359-1369.

"Electrical resistivity and absolute thermoelectric power of liquid indium-nickel-manganese ternary alloys", J. Auchet et al., J. Phys.: Condens. Matter 11 (1999), pp. 3043-3050.

"Electroforming with Heat-Resistant, Sulfur-Hardened Nickel," W.R. Wearmouth et al., Journal of American Electroplaters' Society, (1979), vol. 66, No. 10, pp. 53-57.

(Continued)

*Primary Examiner*—Jennifer C McNeil
*Assistant Examiner*—Adam C Krupicka
(74) *Attorney, Agent, or Firm*—Jaquelin K. Spong

(57) ABSTRACT

A material for forming a conductive structure for a MEMS device is described, which is an alloy containing about 0.01% manganese and the remainder nickel. Data shows that the alloy possesses advantageous mechanical and electrical properties. In particular, the sheet resistance of the alloy is actually lower than the sheet resistance of the pure metal. In addition, the alloy may have superior creep and higher recrystallization temperature than the pure metal. It is hypothesized that these advantageous material properties are a result of the larger grain structure existing in the NiMn alloy film compared to the pure nickel metal film. These properties may make the alloy appropriate for applications such as MEMS thermal electrical switches for telecommunications applications.

20 Claims, 10 Drawing Sheets

OTHER PUBLICATIONS

"Electrical Resistivity Handbook," G.T. Dyos et al., (1992), Peter Peregrinus Ltd., London, United Kingdom, pp. 26-27, 440-441, and 728.

Yang, et al. "Metallurgy of high strength Ni-Mn microsystems fabricated by electrodeposition," Nov. 26, 2009, Scripta Materialia, 51, pp. 761-766.

* cited by examiner

NiMn alloy film

Pure nickel film

MEMS DEVICE USING NIMN ALLOY AND METHOD OF MANUFACTURE

CROSS-REFERENCE TO RELATED APPLICATIONS

Not applicable.

STATEMENT REGARDING FEDERALLY SPONSORED RESEARCH

Not applicable.

STATEMENT REGARDING MICROFICHE APPENDIX

Not applicable.

BACKGROUND

This invention relates to a microelectromechanical systems (MEMS) device and its method of manufacture. More particularly, this invention relates to a material and process for forming a MEMS electrical switch on a substrate.

Microelectromechanical systems (MEMS) are very small moveable structures made on a substrate using lithographic processing techniques, such as those used to manufacture semiconductor devices. MEMS devices may be moveable actuators, sensors, valves, pistons, or switches, for example, with characteristic dimensions of a few microns to hundreds of microns. A moveable MEMS switch, for example, may be used to connect one or more input terminals to one or more output terminals, all microfabricated on a substrate. The actuation means for the moveable switch may be thermal, piezoelectric, electrostatic, or magnetic, for example.

A thermal electrical switch may be formed, for example, by placing a conductive circuit adjacent to an elastically deformable flexor beam, and heating the conductive circuit by driving a current through it. The conductive circuit may be tethered to the elastically deformable flexor beam by a dielectric tether, such that the current does not flow to the deformable flexor beam from the conductive circuit. The conductive circuit may heat from Joule heating and expand relative to the deformable flexor beam, thus deflecting the deformable flexor beam to which it is tethered. If the elastically deformable flexor beam is coupled to an input terminal carrying an electrical signal, energizing the conductive circuit may deflect the elastically deformable flexor beam to a position in which it is in contact with another terminal, thereby connecting an input terminal to an output terminal and closing a switch. The conductive circuit and deformable component may therefore constitute an electrical switch. Such a switch may be used in, for example, telecommunications applications.

Because the thermal MEMS switch uses electricity and transmits an electrical signal, its various components may be made from conductive materials having specific electrical attributes. In particular, the conductive circuit of this thermal switch may need to have a finite resistivity, in order to carry the current, and be heated by the current. However, the elastically deformable flexor beam needs low resistivity, in order to carry the electrical signal without a large loss. However, in order to simplify the manufacture of such a switch, they are typically made out of the same material, and deposited in the same process step. As a result, the material forming the conductive circuit may not be optimized for its intended function, and the material forming the passive component may also not be optimized for its intended function.

Among the mechanical properties desired for the deformable flexor beam are high elasticity, such that the deformable flexor beam returns to its original position after deflection by the conductive circuit, high yield strength so that it is not permanently deformed by the deflection. Therefore, in addition to the low resistance needed by the flexor beam, it may also be advantageous to use a material with high elasticity and high strength. Among the characteristics desired for the conductive circuit are relatively low strength and somewhat higher resistance. Nonetheless, pure nickel is typically used for both the passive flexor beam as well as for the conductive circuit because of its generally acceptable resistance values and ease of well-known deposition processes, such as electroplating. However, nickel has relatively poor creep and strength characteristics, such that it is far from an ideal material from which to fabricate the switch components, particularly the flexor beam.

SUMMARY

It is known that alloying the nickel with impurities such as manganese may be expected to improve the mechanical characteristics, especially in terms of creep and strength. However alloying also tends to raise the resistivity of the material because of increased electron scattering by the alloying material in the lattice or grain boundaries of the crystal matrix. Accordingly, alloys such as NiMn are generally not considered to be appropriate choices for the fabrication of the MEMS electrical switch, because the increased resistance would lead to unacceptable losses in signal strength through the switch.

Materials and processes are described here which address the above-mentioned problems, and may be particularly applicable to the formation of a MEMS thermal switch. The materials and processes described herein use a very small amount of manganese to form a NiMn alloy with less than about 0.1% manganese. It has been found that even this small additional amount of manganese is sufficient to dramatically improve the mechanical properties of the alloy. It has also been found that in contrast to raising the resistivity of the NiMn alloy as would be expected, the small amount of Mn actually reduces the sheet resistance of the NiMn alloy. Accordingly, this alloy may be appropriate for use both as the conductive circuit and the passive flexor beam of the thermal switch.

The NiMn alloy includes at least about 0.001% by weight and at most about 0.1% by weight of manganese and at least about 99.9% by weight of nickel. More preferably, the percentage by weight of manganese in the alloy is about 0.01%. This results in a material with higher recrystallization temperature, improved creep, strength, and elasticity, and with lower resistance than the pure Ni. It is hypothesized that the improved properties result from the migration of the Mn to the grain boundaries of the film, promoting larger grains and therefore lower resistance. The larger grains offset the increased scattering due to the alloying material in the lattice of the nickel, and therefore lead to a lower resistance structure.

The NiMn alloy may be well suited to the MEMS thermal switch application, which requires low creep, high strength, high elasticity and low resistance.

The material may be deposited by plating the alloy from a plating bath having appropriate concentrations of manganese and nickel to create the 0.01% Mn alloy. Because it is appropriate for use both as the conductive circuit as well as the flexor beam, both structures may be plated simultaneously in a relatively simple process flow described herein, to produce a MEMS thermal switch.

These and other features and advantages are described in, or are apparent from, the following detailed description.

BRIEF DESCRIPTION OF THE DRAWINGS

Various exemplary details are described with reference to the following figures, wherein.

DETAILED DESCRIPTION

The systems and methods described herein may be particularly applicable to a MEMS thermal switch. However, it should be understood that this embodiment is exemplary only, and that the material disclosed herein may be used in any application requiring structures having good mechanical characteristics as well as low resistance.

Figure 1:
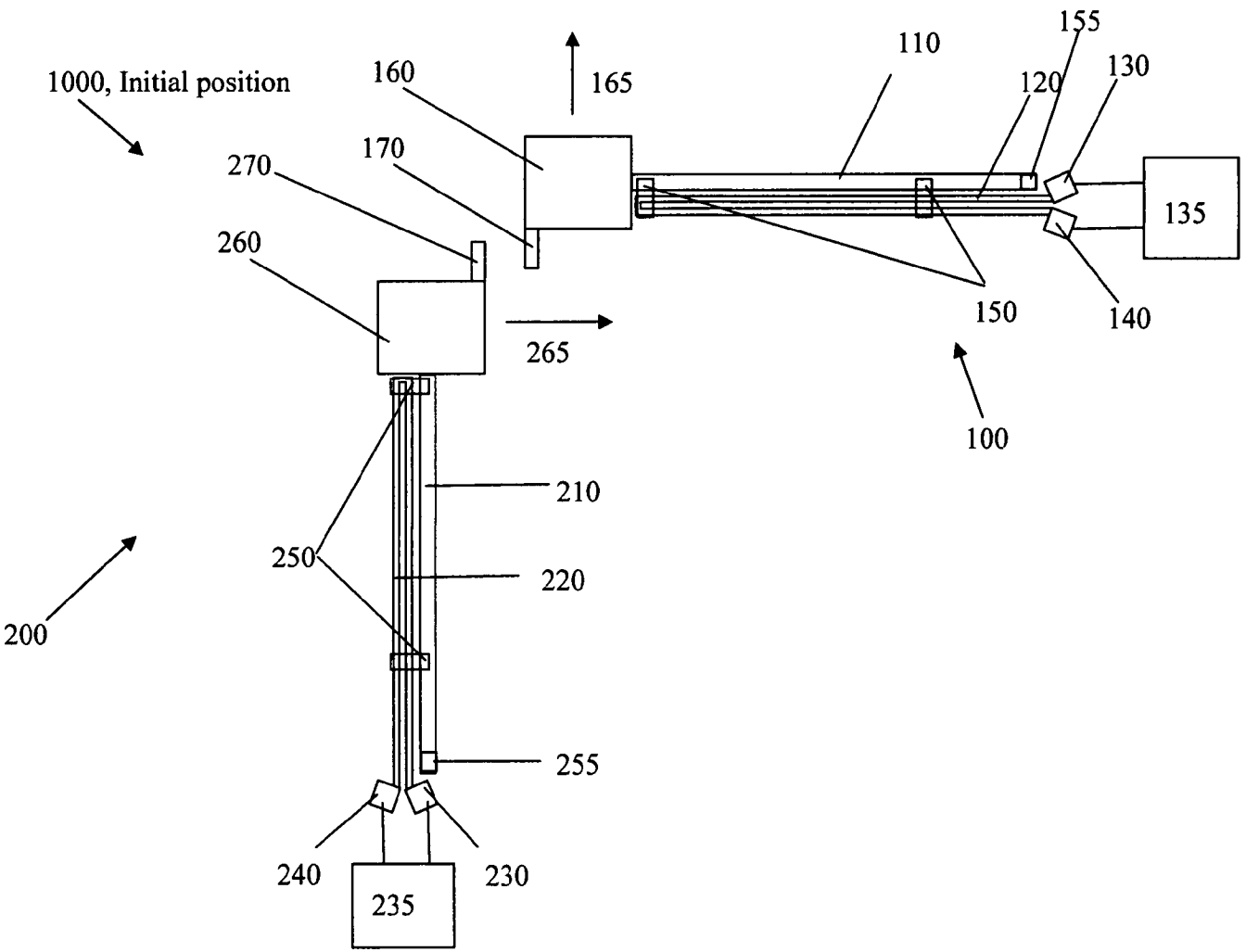
FIG. 1 is a diagram showing an exemplary MEMS thermal switch which is an application appropriate for the material disclosed herein.

FIG. 1 shows an example of a MEMS thermal switch which may be an appropriate application for the material described herein. The thermal switch 1000 may include two cantilevers, 100 and 200. Each cantilever 100 and 200 may contains a flexor beam 110 and 210, respectively. A conductive circuit 120 and 220, may be coupled to each flexor beam 110 and 210 by a plurality of dielectric tethers 150 and 250, respectively. When a voltage is applied between terminals 130 and 140, a current is driven through conductive circuit 120. The Joule heating generated by the current may cause the circuit 120 to expand relative to the unheated flexor beam 110. Since the circuit 120 is coupled to the flexor beam 110 by the dielectric tether 150, the expanding conductive circuit 120 drives the flexor beam in the upward direction 165.

Similarly, applying a voltage between terminals 230 and 240 may cause heat to be generated in circuit 220, which drives flexor beam 210 in the direction 265 shown in FIG. 1. Therefore, one beam 100 moves in direction 165 upon activation and the other beam 200 moves in direction 265 upon activation. These movements may be used to open and close a set of contacts located on contact flanges 170 and 270, each in turn located on tip members 160 and 260, respectively. For example, energizing circuit 120, followed by circuit 220, causes the flexing of cantilever 100 in direction 165 and cantilever 200 in direction 265. If circuit 120 relaxes before circuit 220, the switch may be closed by allowing contact 170 to interfere with the return of contact 270 to its original position, and allowing contacts 170 and 270 to close an electrical circuit between flexor beams 110 and 210. The closure of the switch allows an electrical signal to travel from an input terminal 155 to an output terminal 255. The MEMS thermal switch 1000 may then be opened by reversing the sequence used to close MEMS thermal switch 1000. Opening of the switch disconnects the conductive path between the input terminal 155 and the output terminal 255.

In order for MEMS thermal switch to open reliably, it is required for flexor beams 110 and conductive circuit 120 along with flexor beam 210 and conductive circuit 220 to return to nearly their original positions upon reversal of the sequence described above. If the structures do not return to nearly their original positions, the switch may fail to open properly or fail to close properly, by having contact 170 interfere unintentionally with the motion of contact 270 during the opening or closing operation.

The material of flexor beam 110 or 210 and conductive circuit 120 or 220 is all typically the same, plated nickel, because of its advantageous conducting properties, and ease of deposition. However, nickel also has some disadvantageous attributes, in particular, plastic deformation and/or creep, such that flexor beam 110 or 210 may not return to its original position upon the cessation of drive current through the conductive circuit 120 or 220, respectively. Accordingly, the use of pure nickel may undermine the reliability of MEMS thermal switch 1000. However, as described above, flexor beams 110 and 210 may also carry an electrical signal which is transmitted from an input electrode 155 to an output electrode. In order to transmit the signal without significant losses, the resistance of the flexor beam may need to be a low as possible. Accordingly, a conductor with very low creep, high strength, high elasticity and low resistance, and which is easy to manufacture may be needed to form the flexor beam 110.

It has been determined by the inventors, that the addition of a small amount of manganese (Mn) to nickel to form a NiMn alloy provides much improved mechanical properties, without increasing the sheet resistance of the alloy. In fact, adding a small amount (less than about 0.01% by weight) of manganese actually lowers the sheet resistance as shown in Table 1, below. This is particularly surprising in view of published resistance measurements (T. Farrell et al., J. Phys. C, 1968, Ser. 2, vol. 1, pp. 1359-1369) of a NiMn alloy having 0.5% Mn. The published results indicate that the 0.5% Mn alloy has about a 10% higher resistivity (Ice-point resistivity=7.02 μOhm-cm) than the pure Ni (Ice-point resistivity=6.31 μOhm-cm). Furthermore, this reference states that for dilute alloys, the residual resistance is proportional to the impurity concentration. In other words, the resistance of a NiMn film with any concentration of manganese is expected to be at least as high as the pure metal, and the amount by which it is higher depends on the concentration of the impurity Mn.

However, in contrast to the expectations set forth in the published literature, the resistance of NiMn at very low concentrations (much less than 0.1% by weight) of the impurity metal is actually lower than that of the pure metal. Experimental results summarizing the resistance values for NiMn films where the Mn concentration is on the order of 0.01% is shown in Table 1, below. Unless otherwise stated, all of the measured values of the films presented hereinafter refer to a 0.01% NiMn alloy or a pure Ni sample.

TABLE 1

| Sheet Film Compostion | Pre-Bake Resistance (Ohms/Square) | Bake Temperature (Deg C.) | Post-Bake Resistance (Ohms/Square) | Resistance Change (Deg C.) |
|---|---|---|---|---|
| Ni | 21.5 | 200 | 22.2 | 0.7 |
| Ni | 23.8 | 250 | 21.9 | −1.9 |
| Ni | 23.5 | 300 | 20.3 | −3.2 |
| Ni | 22.1 | 350 | 19.4 | −2.7 |
| NiMn | 16.3 | 200 | 16.2 | −0.1 |
| NiMn | 18.8 | 250 | 18.6 | −0.2 |
| NiMn | 18.3 | 300 | 18.9 | 0.6 |
| NiMn | 15.5 | 350 | 16 | 0.5 |

According to Table 1, the sheet resistance of the NiMn alloy is lower than that of pure Ni, in all cases, before and after baking. The baking step may have the effect of annealing the smaller grains into larger grains, thus reducing the resistance. In fact for the pure metal Ni, the sheet resistance after baking drops from about 22 ohms/square to about 19 degrees centigrade after a 350 degree bake for the pure nickel sample. In contrast, the 0.01% NiMn alloy has a sheet resistance of about 17 ohms/square, and remains relatively constant after baking. This data suggests that the NiMn alloy grains start out relatively large, and do not change dramatically with further annealing. Therefore, in all cases, the sheet resistance of the NiMn alloy films is at least about 10% lower than the sheet resistance of the pure Ni film.

Figure 2:
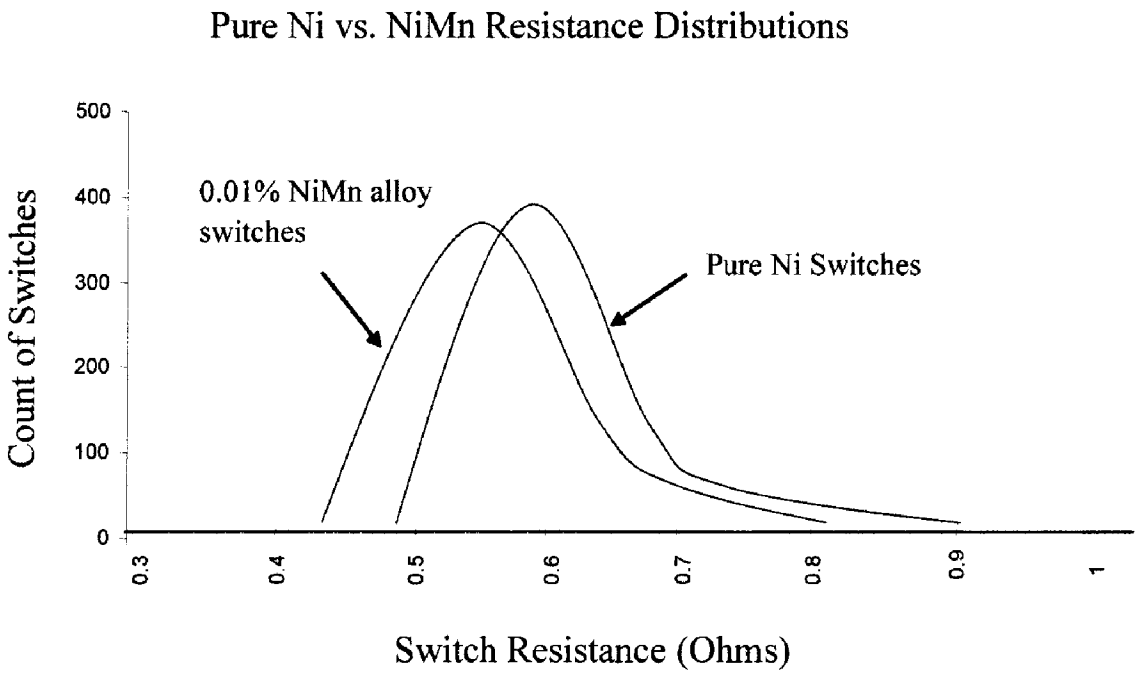
FIG. 2 is a histogram of two populations of MEMS thermal switches, one using pure Ni and the other using the 0.01% NiMn alloy.

FIG. 2 is a histogram showing the distribution of MEMS thermal switches 1000 made according to the design shown in FIG. 1. The switches are made with either pure nickel or the 0.01% NiMn alloy described herein. The data shown in FIG. 2 are generally consistent with the data of Table 1, with the pure nickel switches having generally higher resistance, about 0.6 Ohms, and the NiMn switches having generally about 10% lower resistance, or about 0.54 Ohms. Accordingly, there is little or no resistance penalty for using the NiMn alloy to construct the MEMS thermal switches 1000.

Figure 3A:
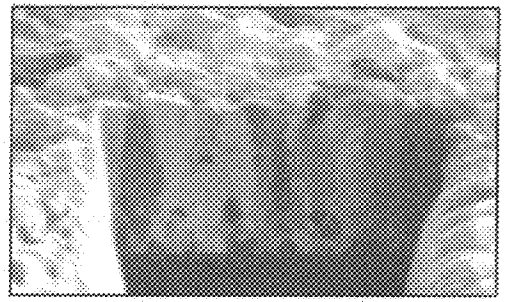
FIGS. 3*a*-3*d* are SEM photomicrographs of samples of pure nickel and samples of 0.01% NiMn, showing the grain structures of the films.
Figure 3B:
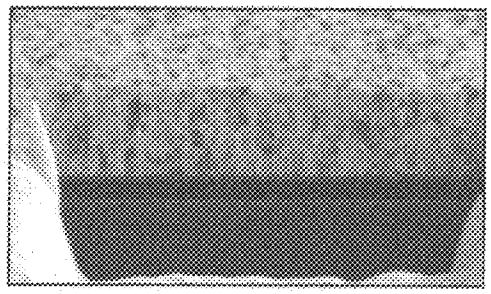
Figure 3C:
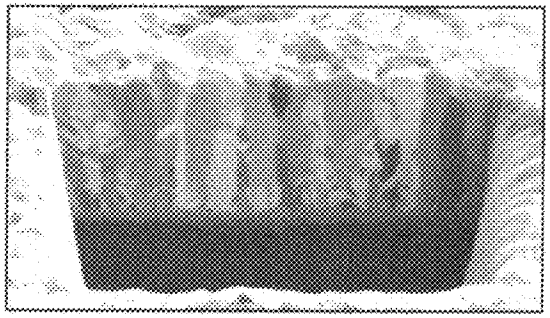
Figure 3D:
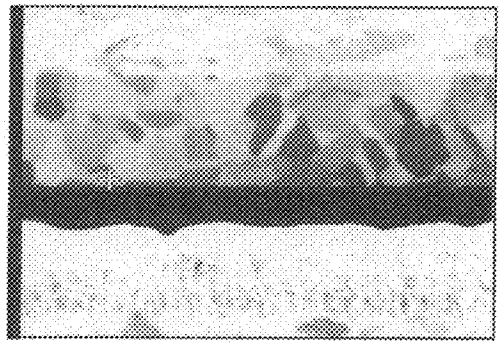

Thus, it is hypothesized that the lowering of the sheet resistance of the alloy occurs as a result of the larger grain size of the alloy compared to the pure material. The larger grains are readily evident in SEM cross sections taken of the material; Exemplary SEM cross sections of the 0.01% NiMn alloy and pure Ni are shown in FIGS. 3*a*-3*d*. FIGS. 3*a* and 3*c* are SEM cross sections of the NiMn alloy film taken at room temperature and after annealing at 350 degrees centigrade respectively. For comparison, FIGS. 3*b* and 3*d* show a pure Ni film under the same conditions. The magnification for each image is the same. As is clearly evident in FIGS. 3*a* and 3*b*, the grain size in the NiMn film is about ten times larger than that in the pure Ni film. In fact, the grain size of the NiMn film is of the order of about 1.0 μm, whereas the grain size in the pure Ni film is of the order of about 0.1 μm. Although the grain size of the pure nickel film increases with annealing temperature as shown in 3*b* and 3*d*, it only approaches the grain size of the NiMn alloy at the highest temperatures. This is consistent with the data shown in Table 1.

The data in FIGS. 3*a*-3*d* and in Table 1 also indicate that the recrystallization temperature of the NiMn film is much higher than that of pure Ni, so that the attributes of the structures made with the NiMn alloy do not change with repeated temperature cycling. This is particularly important in thermal switch applications, wherein temperatures of several hundred degrees centigrade may be reached during the operation of the switch. Accordingly, a MEMS thermal switch using the NiMn alloy may have well defined performance characteristics which do not change substantially over the operating lifetime of the switch.

Figure 4:
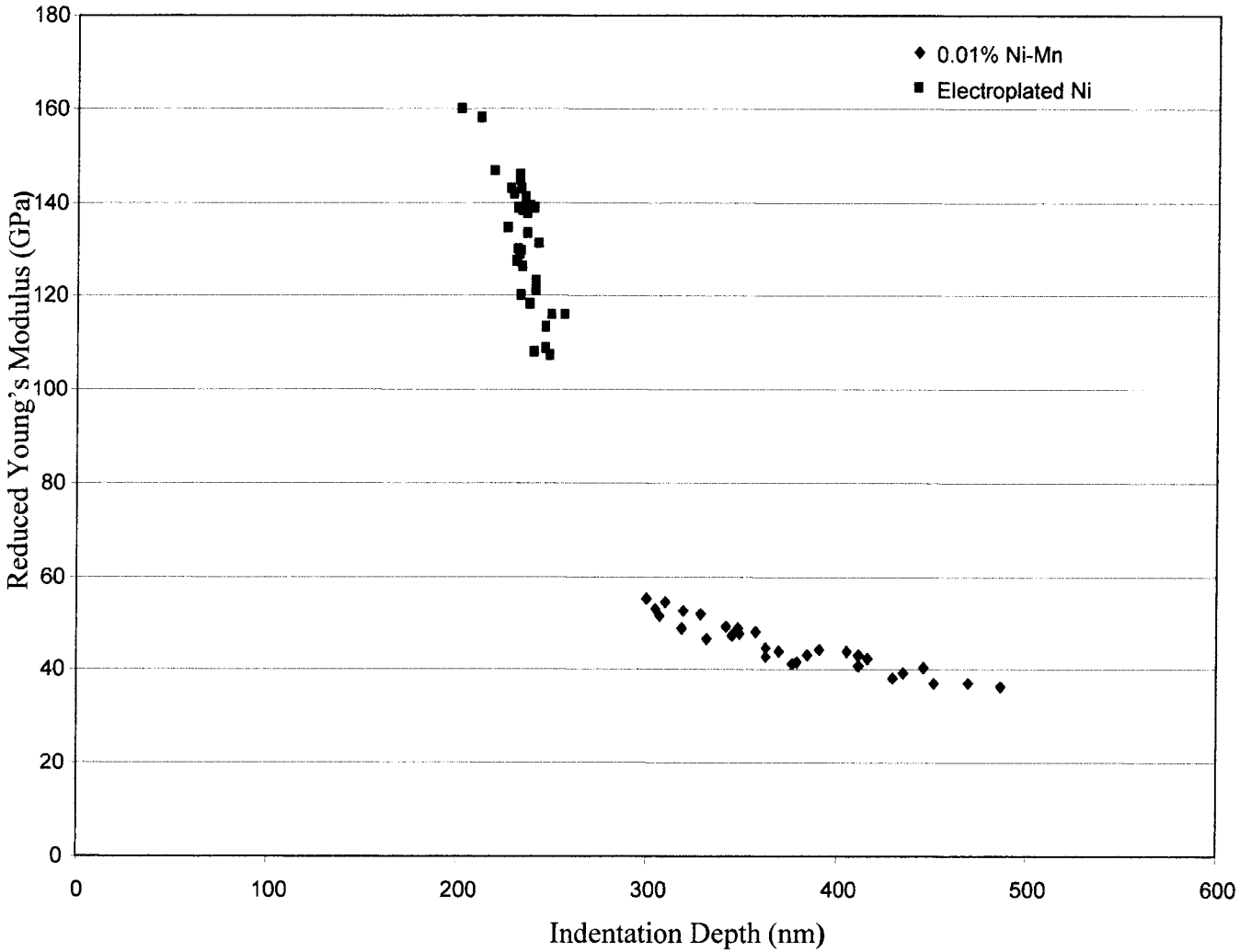
FIG. 4 is a plot of data showing the reduced elastic modulus for films made of pure nickel and switches made from the 0.01% NiMn alloy.
Figure 5:
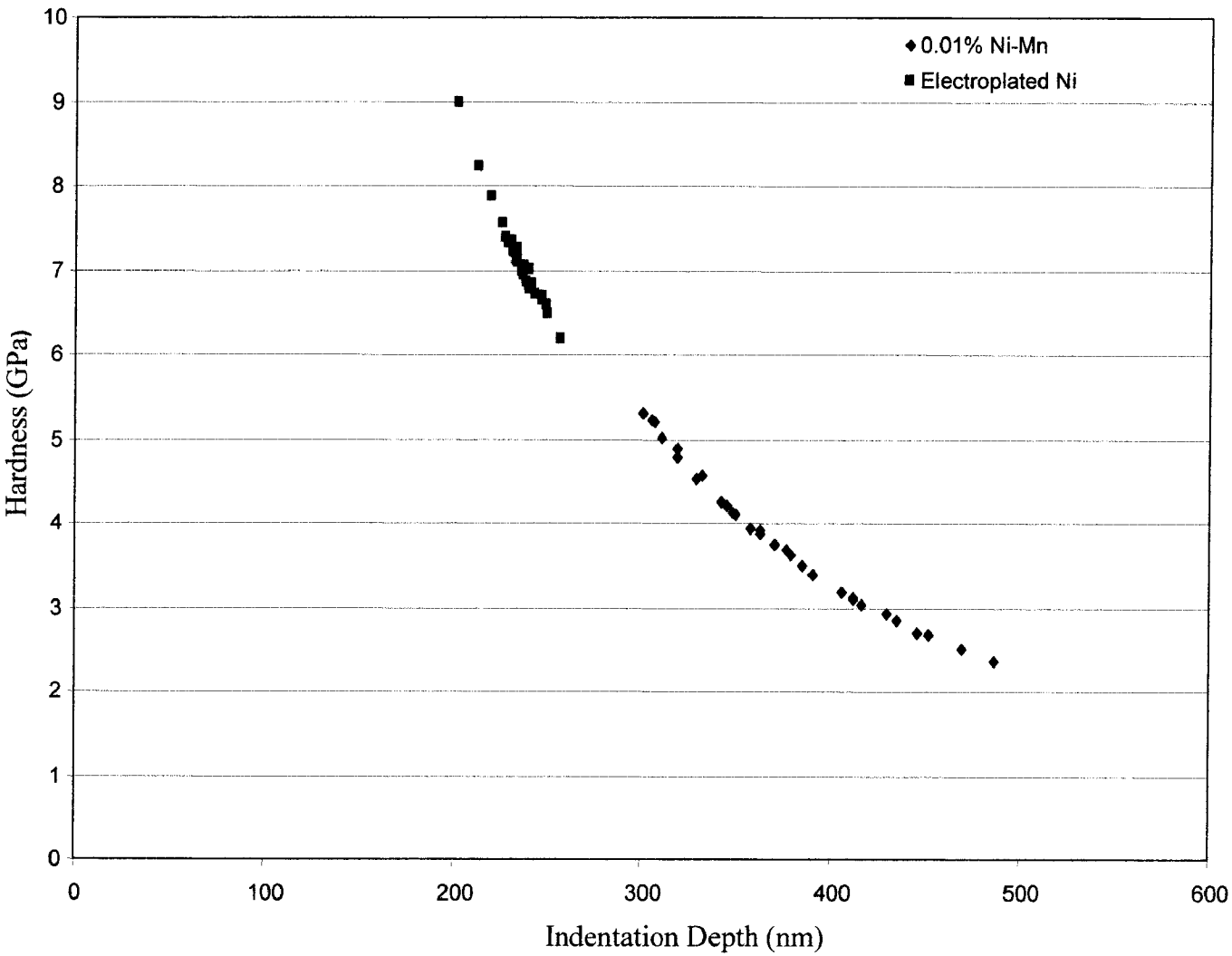
FIG. 5 is a plot of data showing the hardness of films for films made of pure nickel and switches made from the 0.01% NiMn alloy.

In addition to the lower resistance, other mechanical properties of the material may be enhanced, or at least not appreciatively degraded as a result of the addition of the alloying manganese to the pure nickel metal. Among the other mechanical properties of interest for the NiMn alloy are its Young's modulus and hardness. These properties, and their comparison to pure Ni are shown in FIGS. 4 and 5. FIG. 4 shows the reduced Young's modulus of NiMn to be about 30-60 GPa, as compared to a reduced Young's modulus for pure Ni of about 120 GPa. The hardness of the alloy is shown in FIG. 5 to be about 2-5 GPa, as compared to a hardness of the pure Ni of about 6-9 GPa. Therefore, because of the very low weight percentage of manganese added to the alloy, the modulus and hardness values for the alloy are generally within about a factor of two of the values for the pure metal.

Figure 6:
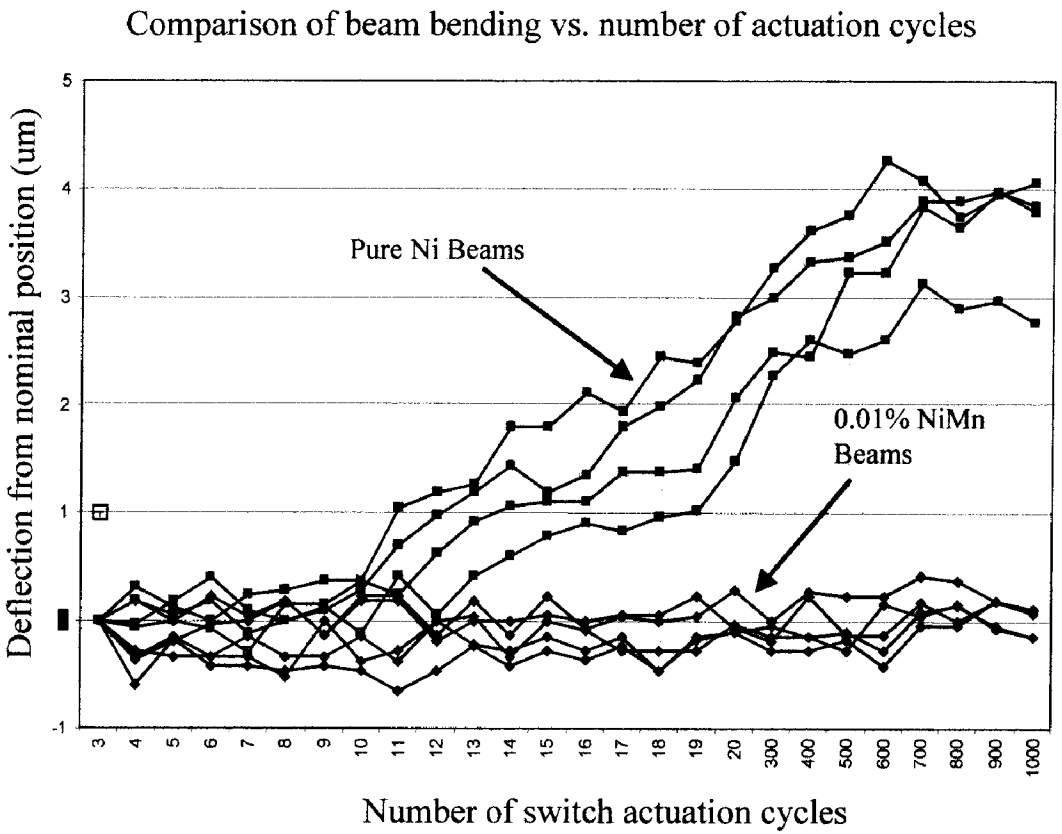
FIG. 6 is a plot showing the inelastic deflection of beams made from pure nickel and beams made from the 0.01% NiMn alloy.

As mentioned above, improving creep and raising the recrystallization temperature is a primary motivation for alloying of the nickel. FIG. 6 shows the improvement in creep and recrystallization performance of the NiMn alloy. FIG. 6 is a plot of the deflection of flexor beams 110 or 210 from their nominal positions, as a function of the number of actuation cycles. As shown in FIG. 6, the NiMn beams maintain their nominal positions even after thousands of cycles, whereas the pure nickel beams become permanently deformed by about 3-4 μm after a thousand cycles. The deformation may result from creep of the material or from recrystallization of the grains during the repeated temperature cycling indicated in FIG. 6. This deformation can seriously impact the performance of the switch, because, as described above, if the inelastic deformation becomes severe enough, the switch may no longer open or close properly, as one contact 170 may relax to a position where it interferes with the return of contact 270 to its nominal position, which would be required to open the switch.

An exemplary method for fabricating the MEMS switch 1000 with the NiMn alloy will be described next. Particular attention will be given to the formation of the conductive circuit and flexor beam portions 120 and 110 of the MEMS switch 1000, as was shown in FIG. 1. Because in FIGS. 7-11, a portion of MEMS switch 1000 is shown in cross section, only one cantilevered beam 400 is used to depict both the flexor beam 110 and the conductive circuit 120. It should be understood that both flexor beam 110 and conductive circuit 120 may be formed simultaneously by the procedure described below. It should also be understood that the second set of cantilevered beams 210 and 220 may be formed at the same time as, and using similar or identical processes as those used to form the first set 110 and 120 of cantilevered beams.

Figure 7:
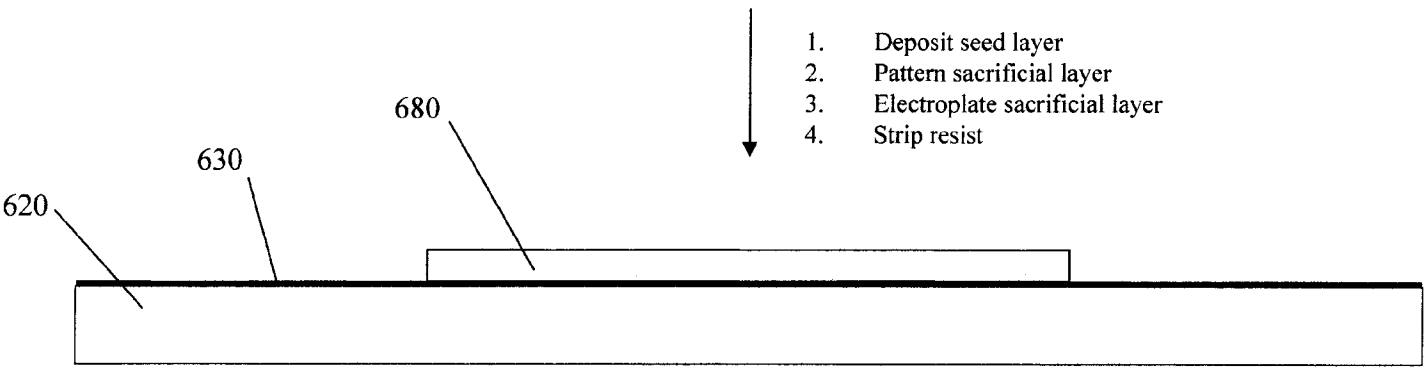
FIG. 7 illustrates a first step in the fabrication of the MEMS thermal switch.

FIG. 7 illustrates a first exemplary step in the fabrication of the MEMS switch 1000. The process begins with the deposition of a seed layer 630 for later plating of the MEMS switch cantilever 400, over the substrate 620. The seed layer 630 may be chromium (Cr) and/or gold (Au), deposited by chemical vapor deposition (CVD) or sputter deposition to a thickness of 100-200 nm. Photoresist may then be deposited over the seed layer 630, and patterned by exposure through a mask. A sacrificial layer 680, such as copper, may then be electroplated over the seed layer. The plating solution may be any standard commercially available or in house formulated copper plating bath. Plating conditions are particular to the manufacturer's guidelines. However, any other sacrificial material that can be electroplated may also be used. In addition, deposition processes other than plating may be used to form sacrificial layer 680. The photoresist may then be stripped from the substrate 620.

Figure 8:
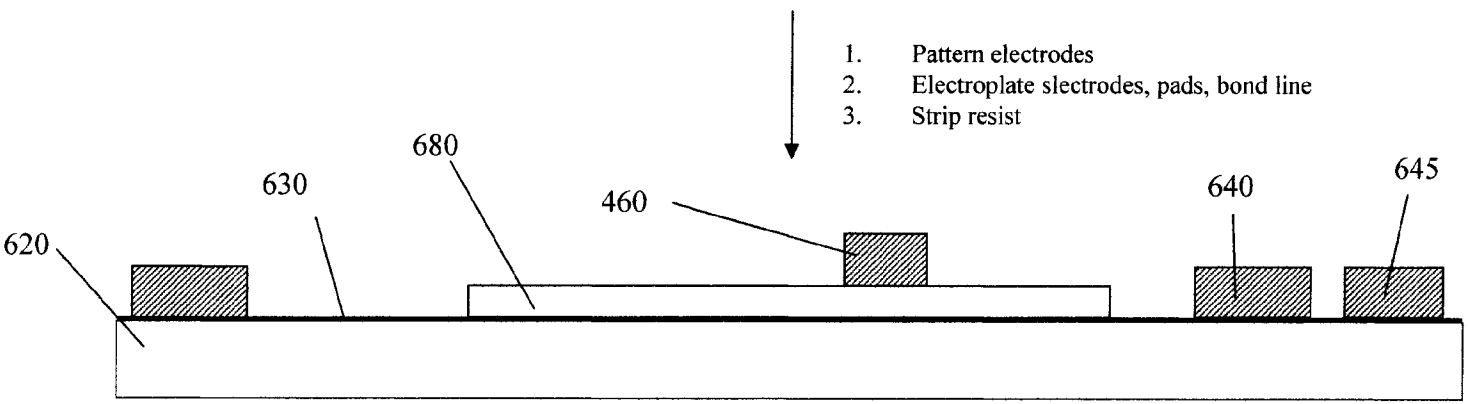
FIG. 8 illustrates a second step in the fabrication of the MEMS thermal switch.

A second exemplary step in fabricating the compact MEMS switch 1000 is illustrated in FIG. 8. In FIG. 8, the substrate 620 is again covered with photoresist, which is exposed through a mask with features corresponding to gold pads 640 and 645 and a gold tip member 460. Gold may be used for the tip member 460 because it may have lower contact resistance than the material that will form the cantilever 400. Gold tip member 460 may represent either of contact tip members 160 or 260 shown in FIG. 1. Although not shown in this view, it should be understood that the features for contact 260 may also be formed in this step. The features 460 and 640 will subsequently be plated in the appropriate areas. The gold features 640, 645 may include a bonding ring; which will eventually form a portion of a hermetic seal which may bond a cap layer over the substrate 620 and switch 1000. Gold feature 645 may also be an external access pad that will provide access to the MEMS switch 1000 electrically, from outside the hermetically sealed structure.

The gold features 640, 645 and 460 may then be electroplated in the areas exposed by the photoresist, to form gold features 640, 645 and 460 and any other gold structures needed. The photoresist is then stripped from the substrate 620. The thickness of the gold features 640, 645 and 460 may be, for example, 1 μm.

Figure 9:
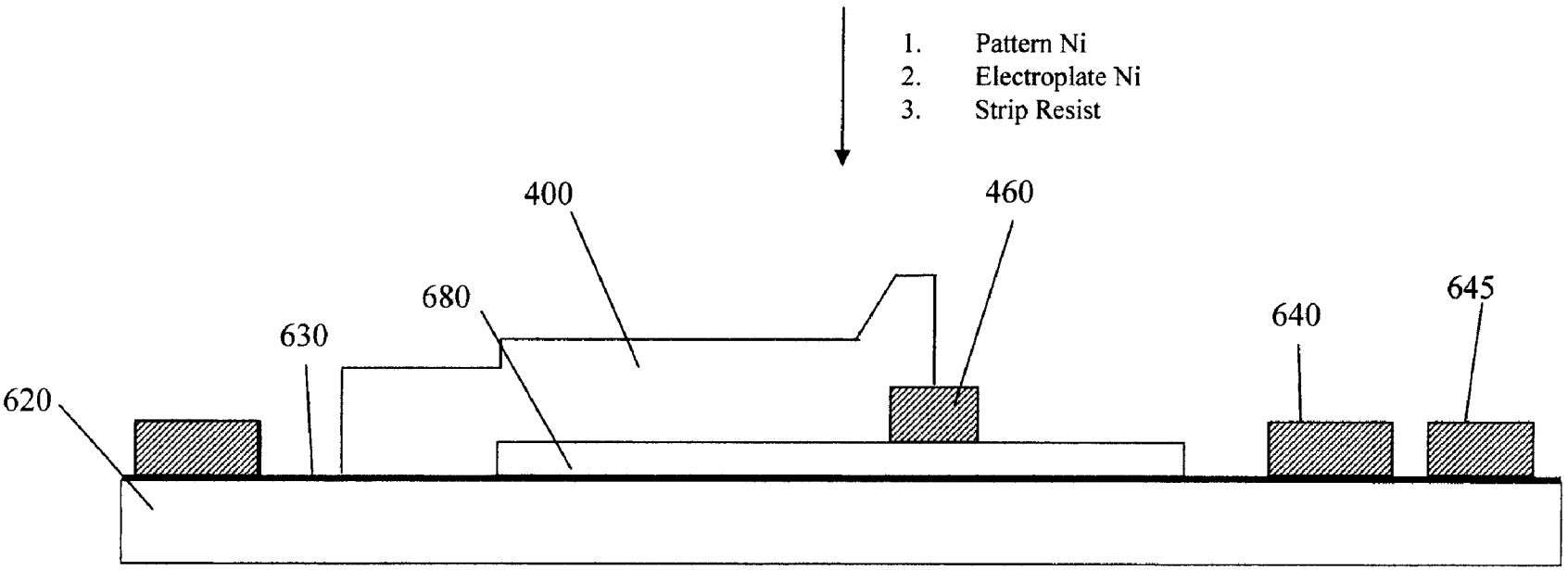
FIG. 9 illustrates a third step in the fabrication of the MEMS thermal switch.

FIG. 9 illustrates a third step in fabricating the compact MEMS switch 1000. In FIG. 9, photoresist is once again deposited over the substrate 620, and patterned according to the features in a mask. The exposed portions of the photoresist are then dissolved as before, exposing the appropriate areas of the seed layer 630. The exposed seed layer 630 may then be electroplated with the NiMn alloy to form the flexor beam and drive loop of the cantilever 400 of the MEMS switch 1000. The thickness of the NiMn flexor beam and drive loop may be about 5 μm, and the height may be about 13 μm. The tip member 460 will be affixed to the conductive cantilever 400 by the natural adhesion of the gold to the NiMn, after deposition. Details of the formation of electroplated NiMn features 400 will be provided below. In addition, deposition processes other than plating may be used to form the NiMn conductive cantilever 400, such as sputter deposition. The photoresist may then be stripped from the substrate 620.

A NiMn plating process used to produce a low resistivity NiMn beam 400 is described below. The method may be practiced using standard thin film electroplating equipment. The NiMn plating bath contains nickel sulfamate, manganese sulfamate, boric acid and a wetting agent in an aqueous solution. The wetting agent may be any standard commercially available nickel sulfamate wetting agent. The plating bath may be prepared having the composition set forth in Table 2:

TABLE 2

| Constituent | Units | Min | Max | Nominal |
|---|---|---|---|---|
| Ni | g/L | 75 | 105 | 89 |
| Mn | g/L | 1.2 | 1.4 | 1.3 |
| Ni:Mn ratio | | 65 | 77 | 73 |
| Boric Acid | g/L | 19.5 | 25.5 | 22.5 |
| Wetting Agent | mL/L | 0.15 | 0.25 | 0.20 |
| pH | | 2.2 | 2.8 | 2.5 |

The acidity of the plating bath may be important because it, along with temperature, current and concentration of the plating bath, it may affect the deposition rate of the NiMn alloy from the plating process. The pH of the plating bath may be adjusted by adding a small amount of sulfamic acid solution to the bath, as described below.

The following steps may be taken to prepare the plating bath of the composition set forth above:

1. Make up a boric acid solution by mixing boric acid with water in a concentration somewhat greater than the eventual target concentration (25.5 g/l) as it will be diluted by subsequent components. For example, a concentration of boric acid of 36 g/l may be prepared for later use.
2. Add nickel sulfamate to the mixing tank such that the nickel concentration is on target.
3. Circulate the solution through a filter to eliminate particles and debris.
4. Add the pre-mixed boric acid such that the boric acid concentration is on target.
5. Add manganese sulfamate such that the Mn concentration is on target.
6. Carefully add sulfamic acid solution with stirring or recirculation to adjust pH to the target value.

Plating Parameters:

TABLE 3

| Parameter | Units | Min | Max | Nominal |
|---|---|---|---|---|
| Temperature | C. | 40 | 60 | 51 |
| Current Density | mA/cm2 | 2 | 20 | 8 |
| Flow Rate | gal/min | 2 | 5 | 2.5 |

According to the plating parameters set forth in Table 3, the plating bath is first heated to a temperature of about 51 degrees centigrade and the substrate 620 is submerged in the plating bath. The flow rate of the solution through the plating bath is set to be about 2.5 gal/min. Upon submerging the substrate 620 in the plating bath, a current density of about 8 $mA/cm^2$ is applied between the electrodes of the plating apparatus until the desired thickness is achieved. The nominal plating rate under these conditions may be about 6 microns per hour. Alternatively, an alternating current waveform may be used to plate the NiMn from the plating bath. The plating results in the deposition of a beam about 13 μm tall of the NiMn alloy as cantilever 400 over the previously formed seed layer 630 and sacrificial layer 680. The alloy composition of the resulting cantilever 400 may be less than about 0.01% manganese and at least about 99.99% nickel. The weight % of the manganese in the NiMn alloy may be adjusted for different applications, by, for example, adjusting the Ni:Mn ratio of the plating bath from the specification of 73, as set forth above, to a lower number for a larger proportion of Mn, for example. This process was used to form the NiMn alloy material for the data shown in FIGS. 3*a*-3*d*, and 4-6.

Figure 10:
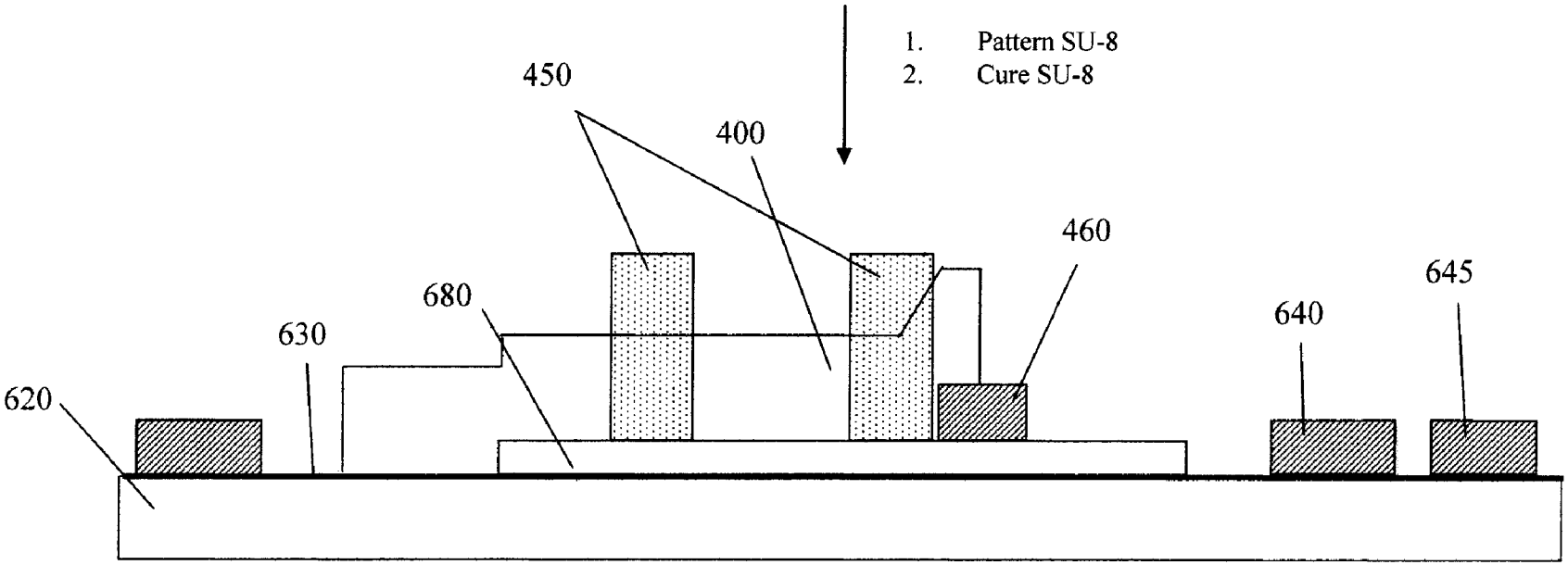
FIG. 10 illustrates a fourth step in the fabrication of the MEMS thermal switch.
Figure 11:
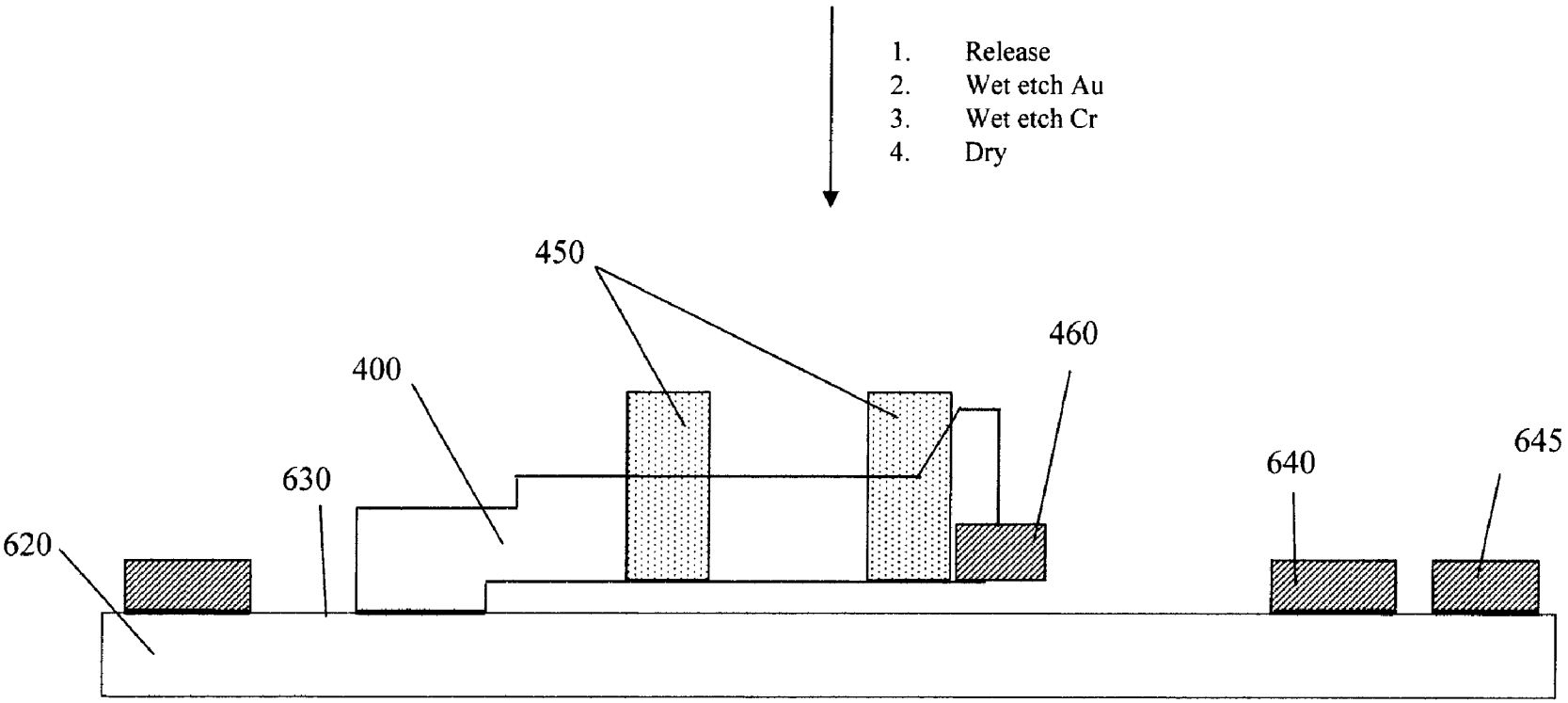
FIG. 11 illustrates a fifth step in the fabrication of the MEMS thermal switch.

FIG. 10 illustrates a fourth step in the fabrication of the MEMS switch 1000. In FIG. 11, a polymeric or other non-conducting material 450 such as the photoresist SU-8 is deposited over the substrate 620, and conductive cantilever 400. The photoresist 450 is then cross-linked, by for example, exposure to UV light through an appropriately patterned lithographic mask. The unexposed resist is then dissolved and removed from the substrate 620 and conductive cantilever 400 in all areas that the dielectric tether is absent. This step forms the dielectric tethers 150 that tether drive loop 120 to cantilevered flexor beam 110. The remaining photoresist 450 may then be cured to obtain advantageous mechanical properties by a process as set forth, for example, in U.S. application Ser. No. 11/364,334, incorporated by reference in its entirety.

Although not shown, it should be understood that dielectric tether 250, flexor beam 210 and drive loop 220 are formed in a manner similar to that described above for dielectric tether 450 and conductive cantilever 400.

FIG. 11 illustrates a fifth step in the fabrication of the MEMS switch 1000. In this step, the conductive cantilever 400 may be released by etching the sacrificial copper layer 680. Suitable etchants may include, for example, an isotropic etch using an ammonia-based Cu etchant. The Cr and Au seed layer 630 is then also etched using, for example, a wet etchant such as iodine/iodide for the Au and permanganate for the Cr, to expose the $SiO_2$ surface of the substrate 620. The substrate 620 and MEMS switch 1000 may then be rinsed and dried.

The resulting MEMS device 1000 may then be encapsulated in a protective lid or cap wafer. Details relating to the fabrication of a cap wafer may be found in co-pending U.S. patent application Ser. No. 11/211,625, incorporated by reference herein in its entirety. Further details regarding the sealing of the cap wafer and the MEMS device 1000 in a hermetic seal may be found in U.S. patent application Ser. No. 11/211,622 incorporated by reference in its entirety.

It should be understood that one gold feature 645 may be used as an external access pad for electrical access to the MEMS switch 1000, such as to supply a signal to the MEMS switch 1000, or to supply a voltage to the terminals 130 or 140 in order to energize the drive loop 120 of the MEMS switch 1000, for example. The external access pad 645 may be located outside the bond line which will be formed upon the bonding of a cap layer to the substrate 620. Alternatively, electrical connections to MEMS switch 1000 may be made using through wafer vias, such as those disclosed in co-pending U.S. patent application Ser. No. 11/211,624, incorporated herein by reference in its entirety.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. While the embodiment described above relates to a microelectromechanical thermal switch, it should be understood that the techniques and materials described above may be applied to any of a number of other microelectromechanical devices, such as valves and actuators. Furthermore, details related to the specific design features and dimensions of the MEMS thermal switch are intended to be illustrative only, and the invention is not limited to such embodiments. Accordingly, the exemplary implementations set forth above, are intended to be illustrative, not limiting.

What is claimed is:

1. A MEMS electrical switch device comprising:

a conductive structure consisting of a NiMn alloy, wherein the NiMn alloy includes at least about 0.001% by weight and at most about 0.1% by weight of manganese and at least about 99.9% by weight of nickel, wherein the conductive structure is a movable, current-carrying feature of the MEMS electrical switch device.

2. The MEMS electrical switch device of claim 1, wherein the conductive structure forms at least a portion of at least one of a radio frequency filter, a signal processor, a telecommunications device, a sensor, an accelerometer and an actuator.

3. The MEMS electrical switch device of claim 1, wherein the percentage of manganese is less than about 0.01%.

4. The MEMS electrical switch device of claim 1, wherein the conductive structure carries an electrical signal in an electrical switch.

5. The MEMS electrical switch device of claim 1, wherein the conductive structure is coupled to a voltage source, which delivers a current to the conductive structure, wherein the current causes the conductive structure to expand.

6. The MEMS electrical switch device of claim 1, wherein the conductive structure is a moveable feature of the MEMS device, and wherein the moveable feature is anchored to a top surface of the substrate, and moves with respect to the top surface of the substrate.

7. The MEMS electrical switch device of claim 1, wherein the NiMn alloy has a sheet resistance lower than about 20 ohms per square.

8. The MEMS electrical switch device of claim 1, wherein the NiMn alloy has a hardness of between about 2 and about 6 GPa.

9. The MEMS electrical switch device of claim 1, wherein the NiMn alloy has a reduced Young's modulus of between about 30 and about 60 GPa.

10. A MEMS electrical switch device comprising:

a conductive structure consisting of a NiMn alloy, wherein the NiMn alloy includes at least about 0.001% by weight and at most about 0.1% by weight of manganese and at least about 99.9% by weight of nickel, wherein the conductive structure is formed by electroplating, and is a cantilevered structure about 13 μm in height.

11. A method for forming a MEMS electrical switch device, comprising:

forming a seed layer over a substrate; and forming a conductive structure consisting of a NiMn alloy, the NiMn alloy having at least about 0.001% by weight and at most about 0.1% by weight of manganese, and at least 99.9% by weight of nickel over the seed layer, wherein the conductive structure is a movable, current-carrying feature of the MEMS electrical switch device.

12. The method of claim 11, further comprising:

providing a plating bath having a solution containing nickel and manganese in a ratio of between about 65 and about 77;

providing electrodes in the plating bath;

applying a current between the electrodes;

electroplating the nickel and manganese from the solution onto the seed layer to form the NiMn alloy of the conductive structure.

13. The method of claim 12, further comprising:

coupling the substrate to at least one of the electrodes.

14. The method of claim 12, wherein applying a current between the electrodes comprises applying a current of between about 2 $mA/cm^2$ and about 20 $mA/cm^2$.

15. The method of claim 12, wherein applying a current between the electrodes comprises applying a current of about 8 $mA/cm^2$.

16. The method of claim 12, wherein electroplating the nickel and manganese to form the NiMn alloy comprises electroplating the NiMn alloy at a rate of about 6 μm per hour.

17. The method of claim 12, wherein providing the plating bath comprises providing a plating bath wherein nickel sulfamate and manganese sulfamate are dissolved in water.

18. The method of claim 17, wherein providing the plating bath further comprises providing a plating bath heated to a temperature of between about 40 degrees centigrade and about 60 degrees centigrade.

19. The method of claim 11, wherein the seed layer comprises at least one of chromium (Cr) and gold (Au), deposited by at least one of chemical vapor deposition (CVD) and sputter deposition to a thickness of about 100 nm to about 200 nm.

20. The method of claim 11, further comprising:

covering the seed layer with photoresist in all areas where the NiMn alloy is not desired.

* * * * *